US007246437B2

(12) United States Patent
Damsohn et al.

(10) Patent No.: US 7,246,437 B2
(45) Date of Patent: Jul. 24, 2007

(54) HEAT EXCHANGER FOR COOLING EXHAUST GAS AND METHOD OF MANUFACTURING SAME

(75) Inventors: Herbert Damsohn, Aichwald (DE); Thomas Karbach, Stuttgart (DE); Conrad Pfender, Besigheim (DE); Jan Wenzelburger, Esslingen (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 11/117,503

(22) Filed: Apr. 29, 2005

(65) Prior Publication Data

US 2005/0189095 A1 Sep. 1, 2005

Related U.S. Application Data

(62) Division of application No. 08/743,002, filed on Nov. 1, 1996, now Pat. No. 6,944,947.

(30) Foreign Application Priority Data

Nov. 1, 1995 (DE) ..... 195 40 683

(51) Int. Cl.
*B23P 15/26* (2006.01)
*F28F 3/02* (2006.01)
*F28F 13/12* (2006.01)

(52) U.S. Cl. ..... 29/890.043; 29/890.053; 165/51; 165/109.1; 165/158; 165/166; 165/170

(58) Field of Classification Search ..... None
See application file for complete search history.

(56) References Cited

U.S. PATENT DOCUMENTS 709,416 A * 9/1902 Maybach ..... 165/148
1,182,271 A * 5/1916 Hersh ..... 165/148
2,488,615 A 11/1949 Arnold
2,941,787 A * 6/1960 Ramen ..... 165/166 X
3,757,855 A * 9/1973 Kun et al. ..... 165/148
4,262,659 A * 4/1981 Brzezinski ..... 165/170 X
4,546,825 A * 10/1985 Melnyk et al. ..... 165/158 X
4,564,062 A * 1/1986 McDougall ..... 165/148
4,688,631 A * 8/1987 Peze et al. ..... 165/166
4,815,535 A * 3/1989 Hagemeister ..... 165/173
4,971,137 A * 11/1990 Thompson ..... 165/166 X (Continued)

FOREIGN PATENT DOCUMENTS

DE 2102744 * 8/1972 ..... 165/175

(Continued)

*Primary Examiner*—Leonard R. Leo
(74) *Attorney, Agent, or Firm*—Crowell & Moring LLP

(57) ABSTRACT

A heat exchanger for cooling exhaust gas, around which a liquid cooling medium flows on the outside, including a bundle of rectangular tubes provided as ducts for the exhaust gas whose ends are welded into tube bottoms. The bundle of rectangular tubes is surrounded with a sheet metal jacket which follows the contour of the bundle and which is provided with a cooling medium inlet and a cooling medium outlet. The ends of the sheet metal jacket are provided with welded-on flange plates which are each open by means of a central opening with respect to the bundle of rectangular tubes and which are provided with fastening devices for fastening onto pipe sections of an exhaust pipe.

2 Claims, 5 Drawing Sheets

U.S. PATENT DOCUMENTS

| | | | | |
|---|---|---|---|---|
| 5,038,754 | A * | 8/1991 | Scala | 165/170 X |
| 5,251,693 | A | 10/1993 | Zifferer | |
| 5,803,162 | A | 9/1998 | Karbach et al. | 165/109.1 |
| 6,321,835 | B1 * | 11/2001 | Damsohn et al. | 185/159 |

FOREIGN PATENT DOCUMENTS

| | | | | |
|---|---|---|---|---|
| DE | 2 69 073 | | 6/1989 | |
| DE | 4035896 | C1 * | 1/1992 | 29/890.039 |
| DE | 41 41 556 | | 6/1993 | |
| DE | 94 06 197 | | 7/1994 | |
| EP | 02 45 022 | | 11/1987 | |
| FR | 367710 | | 11/1906 | |
| GB | 2224821 | | 5/1990 | |

* cited by examiner

HEAT EXCHANGER FOR COOLING EXHAUST GAS AND METHOD OF MANUFACTURING SAME

This application is a divisional of prior application Ser. No. 08/743,002, filed Nov. 1, 1996 now U.S. Pat. No. 6,944,947.

BACKGROUND AND SUMMARY OF THE INVENTION

This invention relates to a heat exchanger for cooling exhaust gas of an internal-combustion engine having a plurality of ducts for guiding the exhaust gas which are provided with lugs arranged in pairs diagonally to the flow direction and projecting from at least one wall of the ducts, and a liquid cooling medium flowing on the outside around the ducts. This invention also relates to a method of manufacturing such a heat exchanger.

In the case of a known heat exchanger of the initially mentioned type, the ducts are formed of disk-shaped heat exchange elements between which one turbulence insert respectively is arranged which has lugs which are arranged in pairs and extend diagonally to the flow direction. This heat exchanger known from German Patent Document DE-U 94 06 197.1 fulfills its task satisfactorily. However, considerable expenditures are required to implement heat exchangers of different sizes for different vehicles because the individual elements must then be manufactured with accurate measurements in the different sizes.

It is an object of the invention to provide a heat exchanger of the initially mentioned type which can be manufactured in different sizes, in which case no excessively high variations in dimension must be maintained for the individual structural elements.

This and other objects have been achieved according to the present invention by providing a bundle of rectangular tubes as ducts for the exhaust gas whose ends are welded into latticed tube bottoms, wherein the bundle of rectangular tubes is surrounded by a sheet metal jacket which follows the contour of the bundle, is provided with a cooling medium inlet and a cooling medium outlet and is welded to the tube bottoms, and wherein the ends of the sheet metal jacket are provided with welded-on flange plates which are open with respect to the bundle of rectangular tubes by way of a central opening and which are provided with fastening devices for attachment with pipe sections of an exhaust gas pipe.

This and other objects have been achieved according to the present invention by providing a heat exchanger for cooling exhaust gas of an internal-combustion engine, comprising a plurality of tubes for guiding exhaust gas; first and second latticed tube bottoms, each tube bottom defining a plurality of openings corresponding to an outer periphery of respective of the tubes, first and second axial ends of each of the tubes being arranged in respective of the openings in the first and second tube bottoms such that the tube bottoms support the tubes substantially parallel to one another and spaced-apart from one another in a bundle; a sheet metal jacket concentrically surrounding the bundle and attached to the tube bottoms, the sheet metal jacket and the tube bottoms defining a chamber, the sheet metal jacket being provided with a coolant inlet and a coolant outlet to allow a liquid coolant to enter the chamber, flow around an exterior surface of the tubes in the chamber, and exit the chamber; and flange plates attached to ends of the sheet metal jacket and configured for attachment to an exhaust pipe, each the flange plate defining an opening which communicates an interior of the tubes with an interior of the exhaust pipe.

This and other objects have been achieved according to the present invention by providing a method of manufacturing a heat exchanger for cooling exhaust gas of an internal-combustion engine, the method comprising the steps of: providing a plurality of rectangular tubes for guiding exhaust gas; attaching a plurality of lugs to the rectangular tubes diagonally to a flow direction of the exhaust gas, the lugs being arranged in pairs; attaching ends of the rectangular tubes to the latticed tube bottoms such that the rectangular tubes form a bundle; attaching a sheet metal jacket to the tube bottoms and around the bundle; providing the sheet metal jacket with a coolant inlet and a coolant outlet to allow a liquid coolant to flow around the rectangular tubes in the sheet metal jacket; and attaching flange plates to ends of the sheet metal jacket, the flange plates being configured for attachment to an exhaust pipe, each flange plate defining a central opening which communicates the rectangular tubes with the exhaust pipe.

The heat exchanger according to the present invention essentially comprises sheet metal components which can be manufactured in a simple manner, for example by welding. Welding is preferably carried out by laser welding or micro TIG welding. The latticed tube bottoms, which may be stamped out of a steel plate, have openings corresponding to the number and arrangement of the rectangular tubes. In certain preferred embodiments, the thickness of the steel plate is approximately 1 mm to 3 mm. The distances between the rectangular tubes, and correspondingly the web width of the tube bottoms, vary according to the desired mass flow rate of the coolant. In certain preferred embodiments, these distances are approximately 1 mm to 3 mm. The outer contour of the tube bottoms depends upon the number and the arrangement of the flat tubes. The sheet metal jacket also may be made in a simple manner from a steel plate which has a sheet metal thickness which is similar to the tube bottoms. The sheet metal jacket can be edged in a simple manner in steps corresponding to the contour of the tube bottoms. The flange plates, which are provided with fastening devices, permit in a simple manner an arrangement of the heat exchanger between two pipe sections of an exhaust pipe, for example, in a manner similar to the arrangement of a catalyst.

In a further development of the invention, the rectangular tubes are each formed by two tube shells which are welded together. The lugs existing in pairs can be fastened directly to the rectangular tube or can be a component of this rectangular tube. However, they can also be a component of inserts arranged in the rectangular tubes.

In a further development of the invention, the flange plates are provided with threaded sleeves in mutually essentially diametrically opposite areas. As a result, the flange plates may be screwed to mating flanges of a pipe section in an exhaust pipe in a simple manner.

In an advantageous further development of the invention, the sheet metal jacket is provided with a cooling medium inlet in the proximity of the flange plate which is in the front in the flow direction of the exhaust gas and is provided with a cooling medium outlet in the proximity of the rear flange plate. As a result, the cooling medium is guided through the heat exchanger in a co-current flow with the exhaust gas. Thus, the risk of a vapor formation on the inlet side of the exhaust gas is reduced because here the cooling medium has the relatively lowest temperature.

In a further development of the invention, the cooling medium inlet and the cooling medium outlet are arranged on opposite sides of the sheet metal jacket. Because of this arrangement, the flow paths of the individual current routes for the cooling medium around the rectangular tubes essentially have the same length ensuring a uniform flow around these rectangular tubes.

In a further development of the invention, the sheet metal jacket is composed of two preformed sheet metal shells which adjoin the tube bottoms by means of joint connections. After being welded together, the two sheet metal shells form a stiff and pressure-resistant housing. The joint connections provide the advantage that the elements to be welded together have a certain cohesion already before being welded, so that the welding operation can be carried out in a relatively simple manner.

For the same purpose, in a further development of the invention the flange plates adjoin the sheet metal jacket by means of joint connections. Furthermore, it is provided for the same purpose that the threaded sleeves adjoin the flange plates by means of a joint connection. As a result, the welding operation can be carried out in a relatively simple manner.

These and other objects, features and advantages of the present invention will become more readily apparent from the following detailed description when taken in conjunction with the accompanying drawings.

DETAILED DESCRIPTION OF THE DRAWINGS

Figure 1:
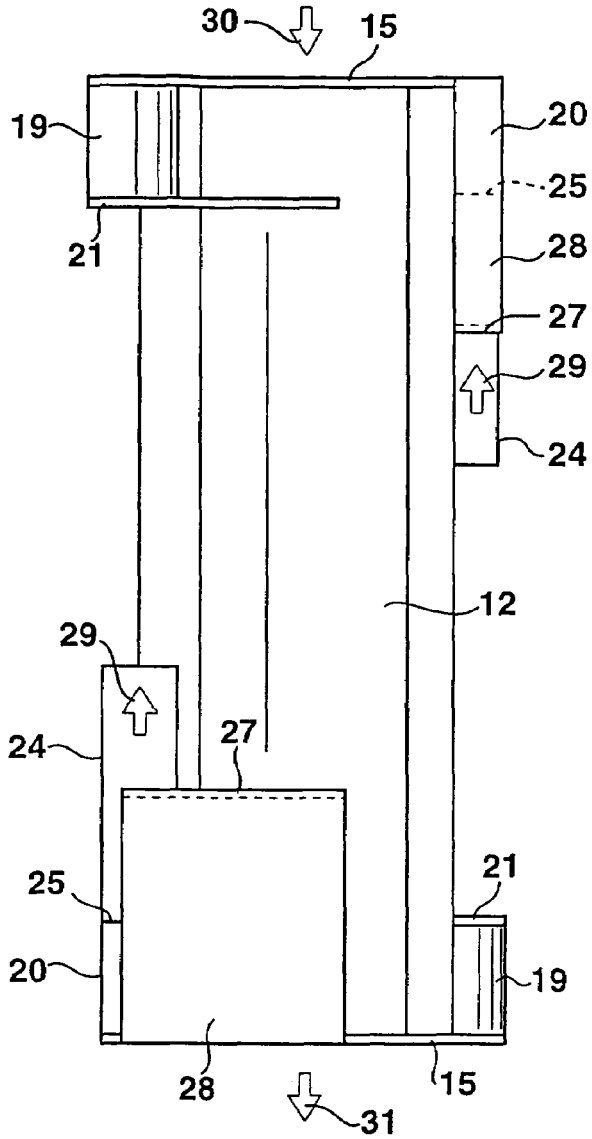
FIG. 1 is an outside view of a heat exchanger according to a preferred embodiment of the present invention.
Figure 2:
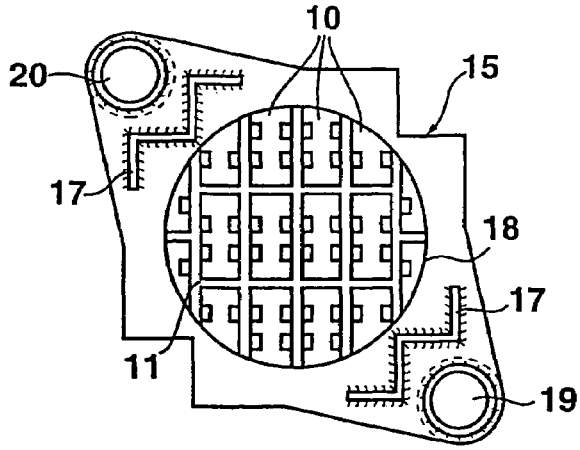
FIG. 2 is a view of the heat exchanger of FIG. 1 in the axial direction.

The heat exchanger illustrated in FIGS. 1 and 2 has a bundle of flat tubes 10 which have a wall thickness of, for example, approximately 0.3 mm to 0.4 mm. The ends of the rectangular tubes 10 are fitted into latticed tube bottoms 11 and are welded to them. Such a tube bottom 11, which is used for receiving 16 rectangular tubes, is shown, for example, in FIG. 7. These tube bottoms 11 are stamped out of a steel plate which have a plate thickness in the order of, for example, from 1 mm to 3 mm. The webs between the openings which are used for receiving the flat tubes have a width which corresponds to approximately the wall thickness of the rectangular tubes 10. Due to the width of the webs between the openings of the tube bottoms 11, the rectangular tubes 10 are spaced apart from each other when arranged in an assembled position in the respective tube bottoms 11. This spaced configuration allows a cooling medium to flow around each of the tubes throughout the axial length of the tubes between the respective tube bottoms 11. The arrangement of the openings and thus of the webs of the tube bottoms 11 is selected such that, in a rough approximation, a circular or oval cross-section is created. The webs which surround the exterior rectangular tubes also have the same web width so that the outer contour of the tube bottoms corresponds to the contour of the tube bundle-enlarged by the web width.

Figure 7:
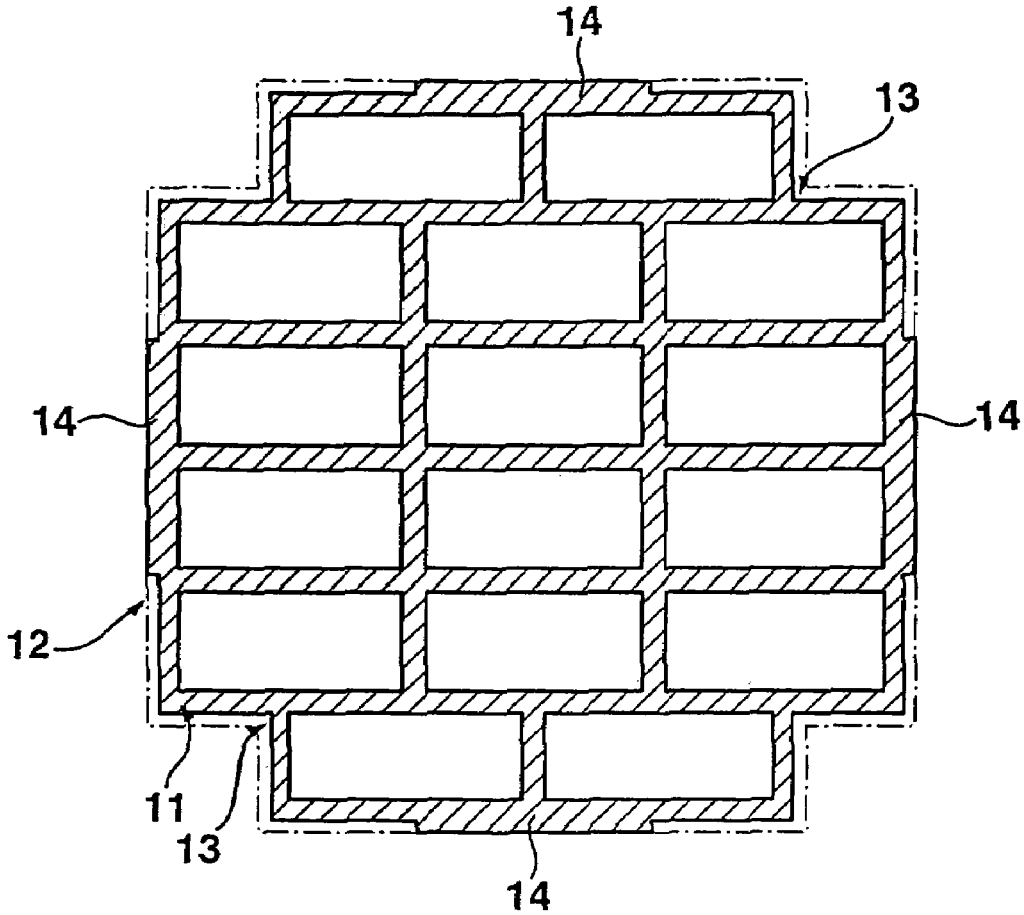
FIG. 7 is an axial view of a latticed tube bottom with an outlined sheet metal jacket.

The tube bottoms 11 are attached, for example welded, to the ends of a sheet metal jacket 12 which is indicated also in FIG. 7 by a broken line. The sheet metal jacket 12 consists of two half shells made of steel plate which has a thickness corresponding essentially to the thickness of the tube bottoms 11. The half shells are shaped corresponding to the outer contour of the tube bottoms 11, and are, for example, edged or made by means of a high-pressure deformation process. The two half shells of the sheet metal jacket 12 are connected with one another, for example by longitudinal weld seams 13. As illustrated in FIG. 7, the tube bottoms 11 are provided with a total of four slightly widened projections 14, which define corresponding recesses for engagement with the ends of the two half shells of the sheet metal jacket 12, effectively creating a joint connection.

Flange plates 15 are connected, for example welded, to the two ends of the sheet metal jacket 12. The flange plates 15 may also be stamped from sheet metal and have a plate thickness which is similar to the plate thickness of the tube bottoms 11. The flange plates 15 protrude in two diametrically opposite areas laterally over the contour of the sheet metal jacket. In this area, the sheet metal jacket 12 has projections which are lengthened in the axial direction beyond the tube bottoms 11 and is fitted by means of these lengthened projections into slot-shaped recesses 17 of the flange plates 15. In this area, the sheet metal jacket 12 is connected to the flange plates 15, for example by welding from the direction of the exterior side of the flange plates and/or welding from the other side.

As illustrated particularly in FIG. 2, the flange plates 15 have central, preferably circular recesses 18 whose dimensions correspond to the adjoining pipe sections of an exhaust system of a vehicle which are not shown.

In the diametrically opposite areas which project beyond the sheet metal jacket 12 toward the outside, the flange plates 15 are provided with threaded sleeves 19, 20. By means of a collar situated on their open sides, the threaded sleeves 19 are fitted into bores of the flange plates 15 and are connected together with them, for example by welding from the direction of the respective exterior side of the flange plates 15. In the area of their closed side, the threaded sleeves 19 have a collar by means of which they are fitted into a holding web 21. This holding web 21 is connected, for example welded, to the threaded sleeves 19 and to the sheet metal jacket 12.

Figure 8:
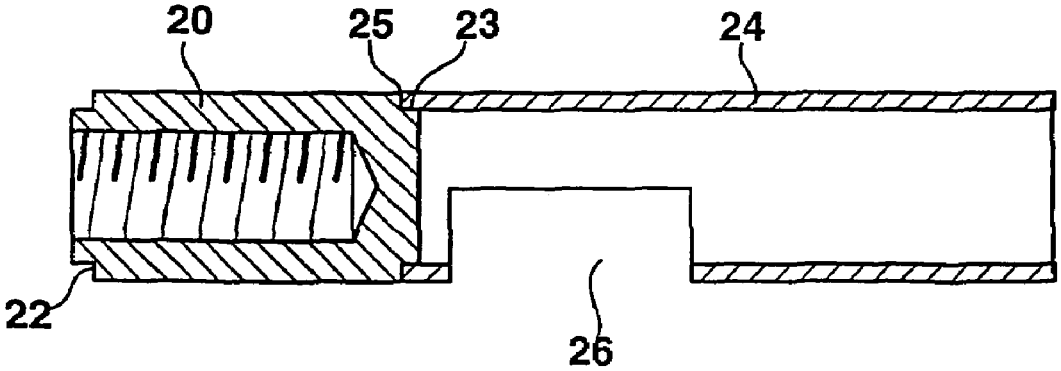
FIG. 8 is an axial sectional view of a threaded sleeve and a connection pipe for a cooling medium inlet or outlet.

The threaded sleeves 20 illustrated in FIG. 8, which are provided with collars 22 on their open sides assigned to the flange plates 15, are provided with collars 23 on their closed sides by means of which they are in each case fitted into a connection pipe 24. The connection pipe 24 and the threaded sleeve 20 are connected to one another, for example by welding along a weld seam 25. The exterior side of the weld seam 25 is ground down. Then a lateral recess 26 is milled into the connection pipe 24. The threaded sleeves 20 are connected, for example welded, with their collar 23 into recesses of the flange plates 15 and are connected, for example welded, to the flange plates 15. The connection pipes 24 are, in addition, connected, for example welded, by means of holding webs 27 to the sheet metal jacket. The respective outer edges of the holding webs 27 extend tangentially with respect to the connection pipe 24 to a plane surface of the sheet metal jacket. They are covered by cover plates 28 which are connected, for example welded, to the sheet metal jacket 12, the holding webs 27, the connection pipe 24, the threaded sleeves 20 and the flange plate 15. Thus, in the area of the recesses 26 between the holding webs 27 and the flange plates 15, a type of water chamber is formed in the area of which the sheet metal jacket is provided with an inlet opening.

As illustrated in FIG. 1, the connection pipes 24 and the water chambers connected therewith are situated on mutually opposite sides of the sheet metal jacket so that an approximately Z-shaped flow path is provided for the cooling medium marked with the arrows 29. In the area of all rectangular tubes 10, this flow path has approximately the same flow route so that a very good and uniform flow around the rectangular tubes 10 takes place. As also illustrated in FIG. 1, the coolant inlet (top of FIG. 1) is arranged on the side on which the inlet of the exhaust gas indicated with the arrow 30 is also situated while the coolant outlet is situated on the outlet side of the exhaust gas indicated by the arrow 31. The cooling medium and the exhaust gas therefore flow in a co-current flow inside the heat exchanger.

As illustrated in FIG. 1 and explained further in FIGS. 3 to 6, the rectangular tubes are equipped with lugs which are arranged in pairs. The lugs project in each case away from opposite walls toward the inside and are arranged diagonally with respect to the flow direction of the exhaust gas in such a manner that they diverge from a narrowest point at an angle, for example at approximately 40°. The rectangular tubes are each welded together from two tube shells 10' which are connected, for example welded, to one another on their respective narrow sides. The tube shells have a plate thickness of approximately 0.3 mm to 0.4 mm. The lugs 32 have approximately the same thickness and a length of approximately ten times their plate thickness. They diverge from a narrowest point, at which they have a distance of approximately 1.2 mm from one another, at an angle of 40°. The height of the lugs 32 amounts to approximately one-fourth to one-third of the overall height of the flat tubes. In the embodiment according to FIGS. 3*a* and 3*b*, the tube halves 10' are provided with slots into which the lugs 32 are inserted and are then welded to the tube halves 10' as shown in FIG. 3*c*. In order to avoid seal welding, the lugs 32 can be provided with one or several elevations on their side facing the tube halves 10' so that they are welded to the tube halves 10' by means of the known stud welding technique.

Figure 3A:
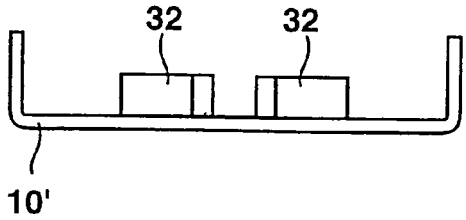
FIGS. 3*a*, 3*b*, and 3*c* show one embodiment of mounting lugs arranged in the interior of rectangular tubes.
Figure 3B:
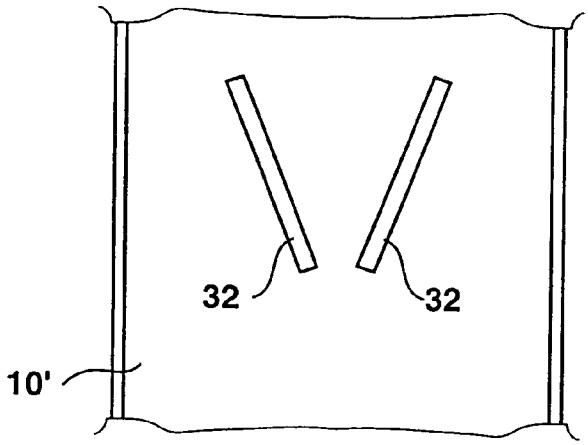

In the illustrated embodiment according to FIGS. 3*a*, 3*b*, the lugs 32 of the two tube halves are arranged opposite one another. In a modified embodiment, the lugs 32 of the two tube halves 10' are arranged eccentrically in such a manner that the lugs 32 of the upper tube half and of the lower tube half 10' are offset with respect to one another in the transverse direction. The distance between the lugs 32 in the flow direction of the exhaust gas amounts to approximately 30 mm.

Figure 4A:
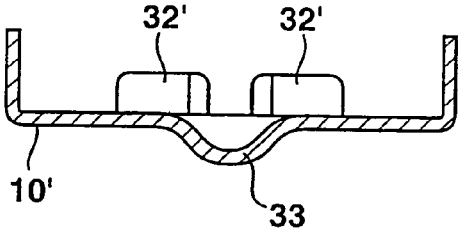
FIGS. 4*a* and 4*b* show another embodiment of mounting lugs arranged in the interior of rectangular tubes.
Figure 4B:
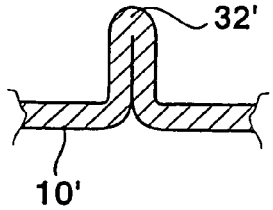

In the case of the embodiment according to FIGS. 4*a* and 4*b*, the lugs 32' are molded in each case out of the tube half 10' by means of deep drawing and pressing-together. A welding operation, particularly a seal welding, in the area of the lugs 32' is therefore eliminated. FIG. 4*a* also shows that the tube half 10' is provided with an outward-directed button-type shaping-out 33. These shaped out parts 33 which, in each case, are arranged in the flow direction between the successive pairs of lugs 32' are used as spacers or spacing elements with respect to the concerned adjacent rectangular tube. Such an arrangement of spacers has advantages particularly in the case of fairly long heat exchangers.

Figure 5A:
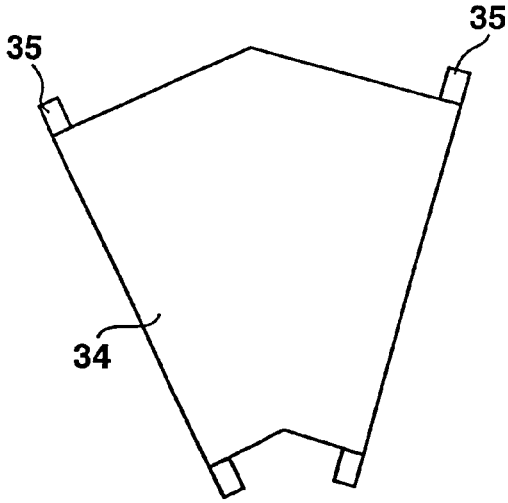
FIGS. 5*a* and 5*b* show another embodiment of mounting lugs arranged in the interior of rectangular tubes.
Figure 5B:
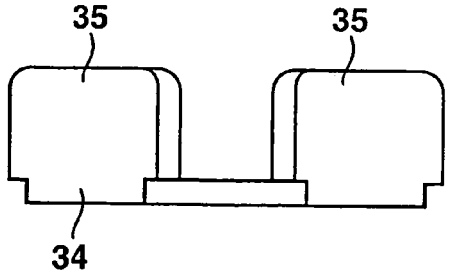
Figure 3C:
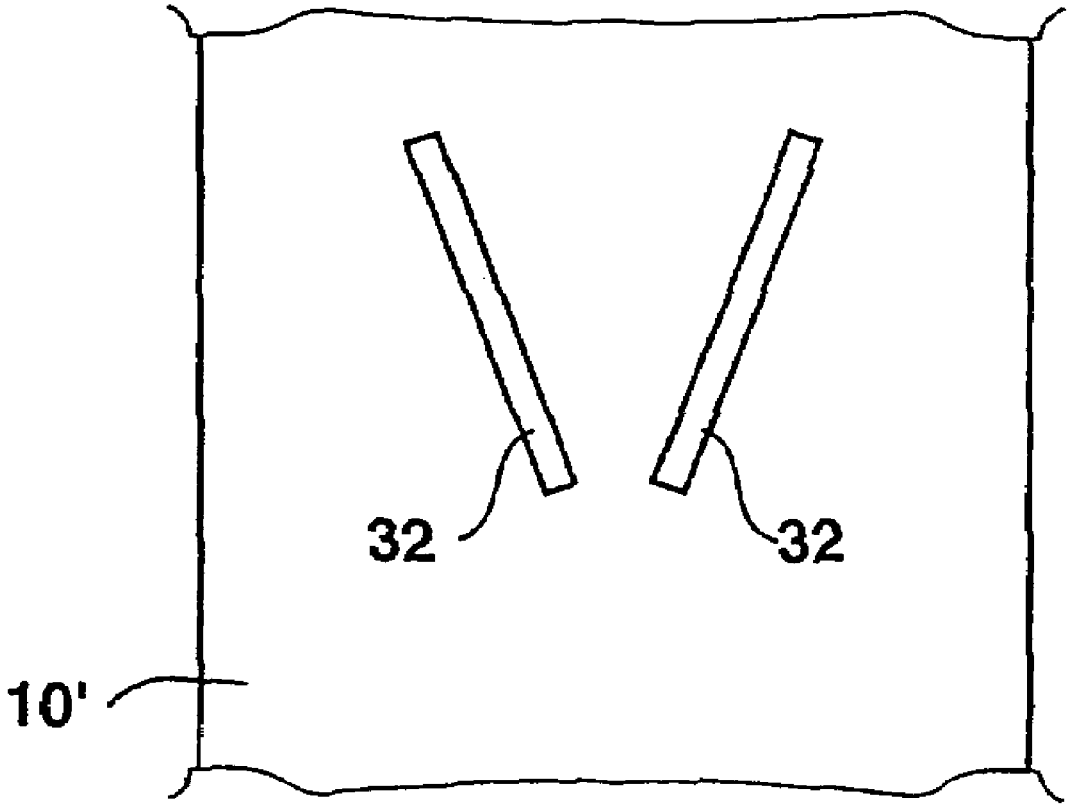

FIG. 5*a* shows a structural element which is an edged sheet metal part 34 which forms pairs of lugs 35. This structural part 34 can be fastened on the tube halves 10' in the area of the web connecting the lugs 35 by means of point welding. This also eliminates seal welding. In a modified embodiment similar to FIGS. 5*a* and 5*b*, the web of the structural part 34 connecting the lugs 35 is provided with lugs which are edged to the opposite side and which are fitted into the slots of the tube half 10' and are welded in and project toward the outside in order to form spacers with respect to the adjacent rectangular tubes 10.

Figure 6:
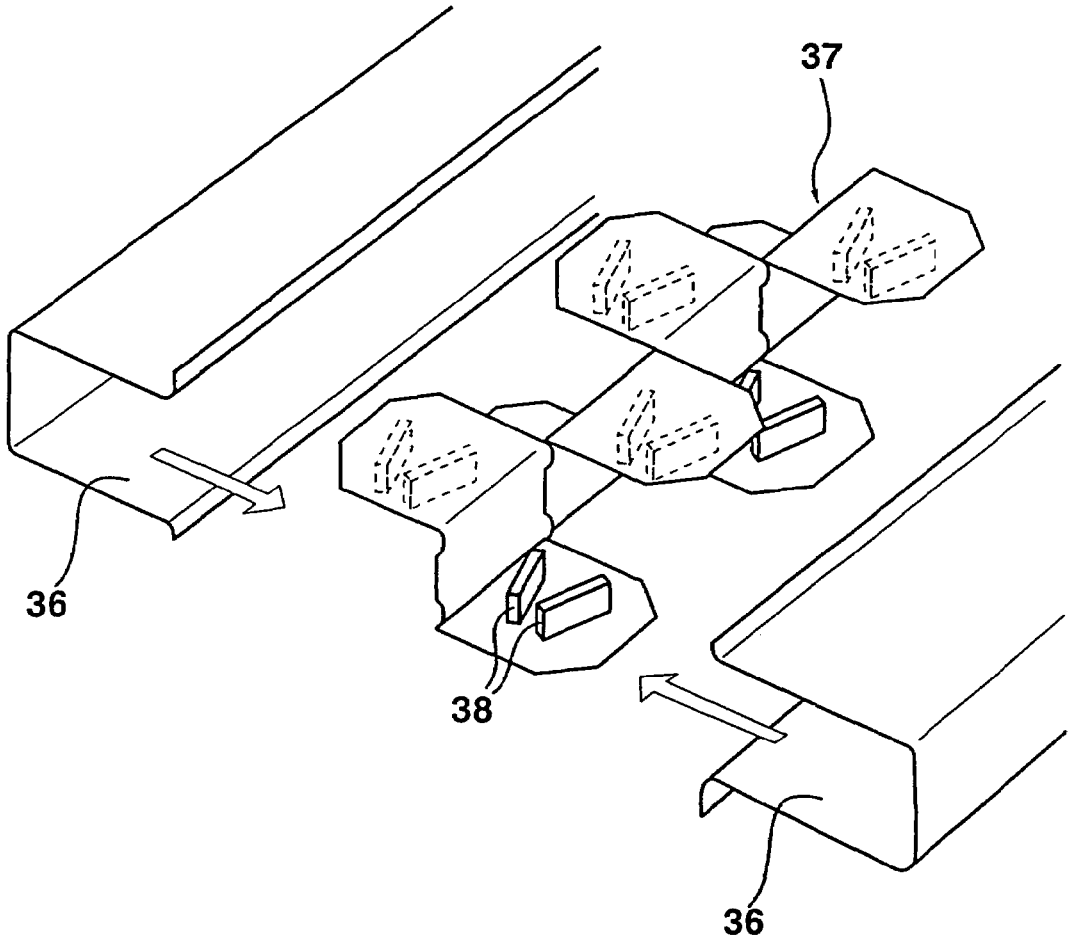
FIG. 6 shows one embodiment of rectangular tubes formed of two tube halves.

FIG. 6 illustrates an embodiment of rectangular tubes which are formed of two tube halves 36 divided in the longitudinal direction in the area of the larger walls. A plate 37, which is deformed into S- and-Z-shaped successive sections, is inserted into the two tube halves 36. The parts, which in each case extend in parallel to the longer walls of the tube half 36, are provided with pairs of lugs 38 which are arranged and constructed corresponding to the explanations regarding FIGS. 3*a* and 3*b*. The tube halves 36 are connected with one another, for example by laser welding or micro TIG welding, in which case the inserted plate 37 is fixed by means of a weld-through.

During manufacture of the present heat exchanger, the tube halves 10' are first provided with the lugs 32, 32', 35 or 38 and are then welded together. The thus formed rectangular tubes are arranged in tube bottoms 11 stamped out in a latticed construction, after which the ends of the rectangular tubes 10 are welded to the tube bottoms. Subsequently, the two profiled sheet metal shells of the sheet metal jacket 12, which are provided with the prepared inlet openings and outlet openings for the cooling medium, are joined to the tube bottoms 11 and welded to them. Then the flange plates 15 are mounted and are welded to the sheet metal jacket 12. Subsequently, the prepared threaded sleeves 19, 20 are fitted onto the flange plates and are welded to them and are welded by means of the holding webs 21, 27 to the sheet metal jacket 12. Then the cover plates 28 are mounted which are welded to the holding webs 27, the sheet metal jacket 12, the connection tubes 24, the threaded sleeves 20 and the flange plates 15 in such a manner that a type of water chamber is formed.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of manufacturing a heat exchanger for cooling exhaust gas of an internal-combustion engine, said method comprising the steps of:

providing a plurality of tube halves;

arranging a plurality of lugs on said tube halves, in pairs, by drawing and pressing together portions of a wall of each of said tube halves to integrally form the lugs from the wall;

joining pairs of said tube halves together to form rectangular tubes for guiding exhaust gas with the lugs arranged diagonally to a flow direction of the exhaust gas;

providing first and second latticed tube bottoms;

welding ends of said rectangular tubes to said latticed tube bottoms such that said rectangular tubes form a bundle;

attaching a sheet metal jacket provided with a coolant inlet and a coolant outlet to the tube bottoms, the inlet and outlet adapted to allow a liquid coolant to flow around said rectangular tubes in said sheet metal jacket; and attaching connections to said tube bottoms, to ends of said sheet metal jacket, or to both said tube bottoms and ends of said sheet metal jacket, said connections being configured for attachment to an exhaust pipe communicated with the exhaust gas from the internal-combustion engine, each said connection defining a central opening for communicating said rectangular tubes with the exhaust pipe.

2. A method according to claim 1, wherein said latticed tube bottoms are preformed.

* * * * *